US006364642B1

(12) United States Patent
Garczorz et al.

(10) Patent No.: US 6,364,642 B1
(45) Date of Patent: Apr. 2, 2002

(54) ROTARY PISTON MACHINE WITH THREE-BLADE ROTORS

(75) Inventors: Reinhard Garczorz, Lörrach; Fritz-Martin Scholz, Hasel, both of (DE)

(73) Assignee: Werner Rietschle GmbH & Co., KG, Schoppheim (DE)

( * ) Notice: Subject to any disclaimer, the term of this patent is extended or adjusted under 35 U.S.C. 154(b) by 0 days.

(21) Appl. No.: 09/673,640

(22) PCT Filed: Apr. 28, 1999

(86) PCT No.: PCT/EP99/02881

§ 371 Date: Jan. 5, 2001

§ 102(e) Date: Jan. 5, 2001

(87) PCT Pub. No.: WO99/57419

PCT Pub. Date: Nov. 11, 1999

(30) Foreign Application Priority Data

Apr. 30, 1998 (DE) ..... 198 19 538

(51) Int. Cl.[7] ..... F01C 1/20
(52) U.S. Cl. ..... 418/15; 418/191
(58) Field of Search ..... 418/15, 191, 206.2, 418/206.5

(56) References Cited

U.S. PATENT DOCUMENTS 3,182,900 A * 5/1965 Thorson ..... 418/206.5
3,199,771 A 8/1965 Becker
5,149,256 A * 9/1992 Schmitz ..... 418/191

FOREIGN PATENT DOCUMENTS

| | | | | |
|---|---|---|---|---|
| DE | 24 22 857 | | 11/1975 | |
| EP | 0 578 853 A | | 1/1994 | |
| FR | 1 147 777 A | | 11/1957 | |
| GB | 818 691 A | | 8/1959 | |
| JP | 62-157289 | * | 7/1987 | ..... 418/15 |
| RU | 666296 | * | 6/1979 | ..... 418/206 |

OTHER PUBLICATIONS

Gunter Leuscher: "Kleines Pumpenhandbuch fur Chemie and Technik," 1967, Verlag Chemie GmbH, Weinheim/Bergstr, XP002113407, Seite 226—Serite 227, Abbildung 4.13.2.

* cited by examiner

*Primary Examiner*—John J. Vrablik
(74) *Attorney, Agent, or Firm*—Nixon Peabody LLP; Stuart J. Friedman

(57) ABSTRACT

In order to simultaneously generate pressure and negative pressure with a single-stage rotary piston machine, said machine has a chamber (18) that is formed in a housing and that is provided with a suction connection, a pressure port and a charging port. In the pump chamber (18), there are two three-blade rotors (30, 32) that work with internal compression and internal expansion and that rotate in opposite directions around parallel spaced axes and these rotors intermesh so as to be free of contact so that, together with the peripheral wall of the pump chamber (18), they define cells **(60, 62*a*, 62*b*, 64)** that are separate from each other.

7 Claims, 5 Drawing Sheets

ROTARY PISTON MACHINE WITH THREE-BLADE ROTORS

Figure 1:
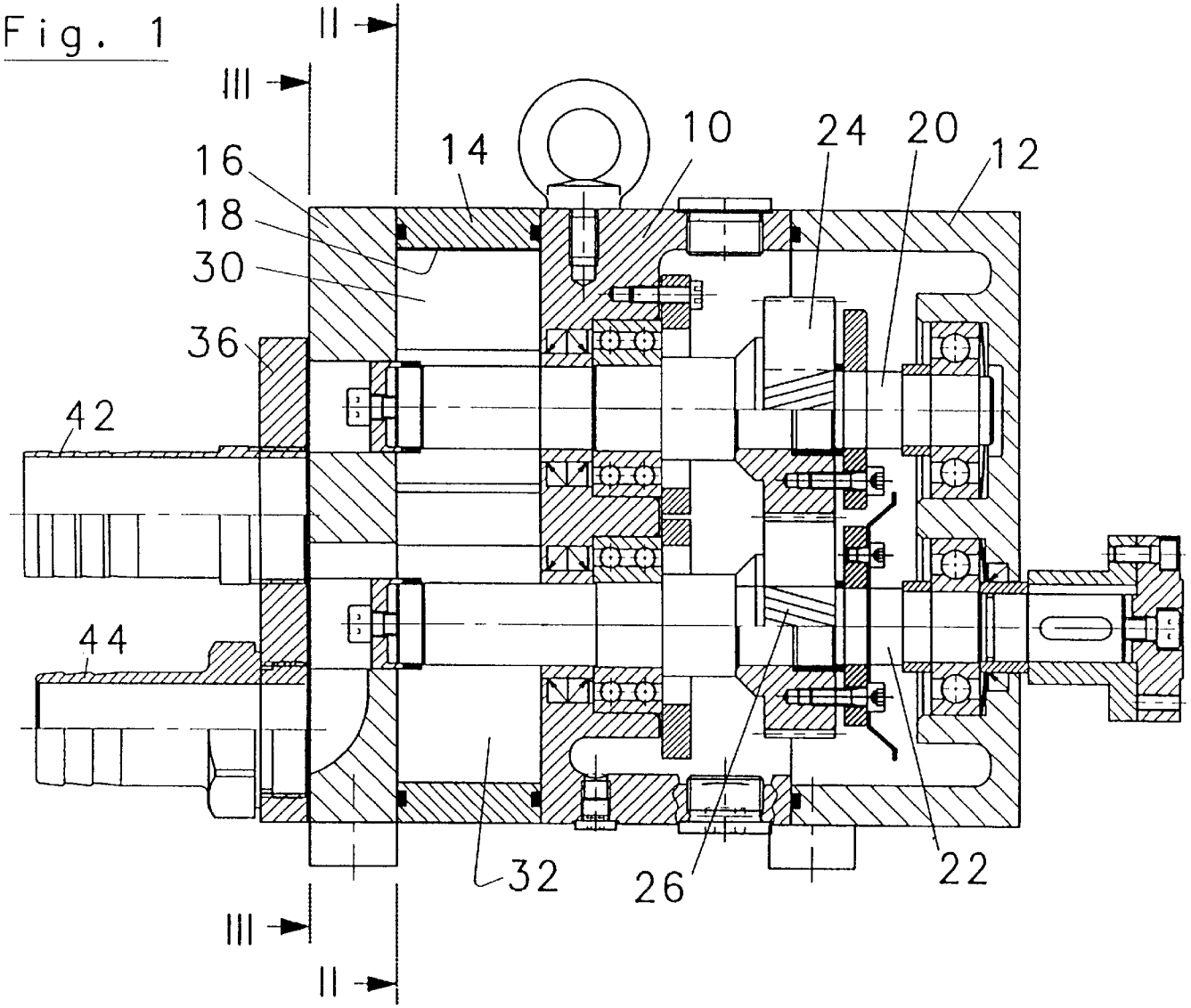

The invention relates to a rotary piston machine comprising a chamber formed in a housing in which three-blade rotors rotate in opposite directions around parallel spaced axes and intermesh so as to be free of contact forming separate cells with the peripheral wall of the chamber and with each other.

Rotary piston machines with three-blade rotors are known as Roots blowers. In such machines, the inlet and the outlet are arranged in alignment with each other along a line that is perpendicular to the axes of the rotors. The volume flow is conveyed by the intermeshing blades in the chamber and pushed out of the outlet without internal compression. Such a rotary piston machine is especially suited as a loader for relatively high volume flows.

The invention provides a rotary piston machine with three-blade rotors that works with internal compression and internal expansion and that is suitable for generating pressure as well as vacuum, even in the case of relatively small volume flows.

With the rotary piston machine according to the invention, the claw-like blades of the rotors, together with the chamber, simultaneously define a suction cell whose volume increases during the rotation of the rotors and they also define a pressure cell whose volume decreases when the rotors rotate. Since the rotary piston machine works with internal compression and, at the same time, with internal expansion, it is suitable for simultaneously generating pressure and negative pressure.

In a further embodiment of the invention, the rotors, together with the chamber, define two charging cells that are initially separated from each other during the rotation of the rotors and that, during the further rotation of the rotors, are united with each other to define the pressure cell. A medium can be fed in via the charging cells so that, at the pressure outlet, an accordingly enlarged volume flow is available. Before being united, the charging cells are shifted essentially isobarically and isochorically in the pump chamber; the medium present in the charging cells does not undergo any considerable change in pressure or volume during the shift of the charging cells.

The geometry of the rotors is determined by the requirement that, in the chamber, the cells necessary for simultaneously generating pressure and vacuum have to be separated from each other. Since the rotors interact so as to be free of contact with each other as well as with the peripheral wall of the chamber, no wear occurs in the area of the pump chamber. The sealing gap between the rotors can be kept very small by optimizing their geometry; in practical embodiments, this gap is just fractions of a millimeter, so that good pressure and vacuum values are ensured. These values even improve with increasing service life since the deposits that form over time reduce the size of the sealing gaps.

The rotary piston machine according to the invention is especially well suited for use as a pump for simultaneously generating compressed air and vacuum. In this application, it is particularly well suited for use in the paper-processing industry, especially in cases that do not require a separate supply or adjustment of compressed air and vacuum. Compressed air is needed, for example, to blow air onto a stack of paper from the side to help separate the sheets. The generation of pulsating compressed air by such a pump proves to be very practical here since the paper edges can be separated more easily by means of the pulsating compressed air that is generated. At the same time, negative pressure is required in such applications to pick up the top sheet of paper.

Figure 3:
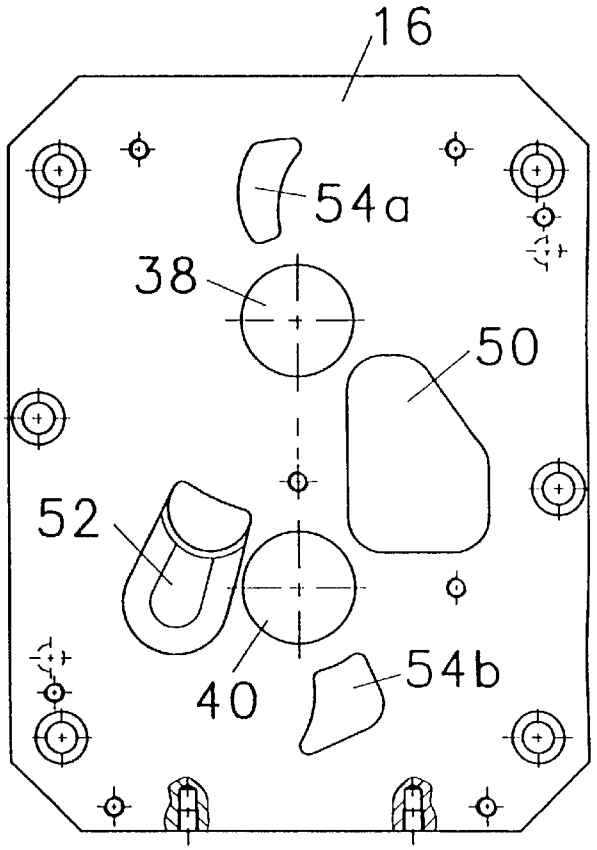
Figure 2:
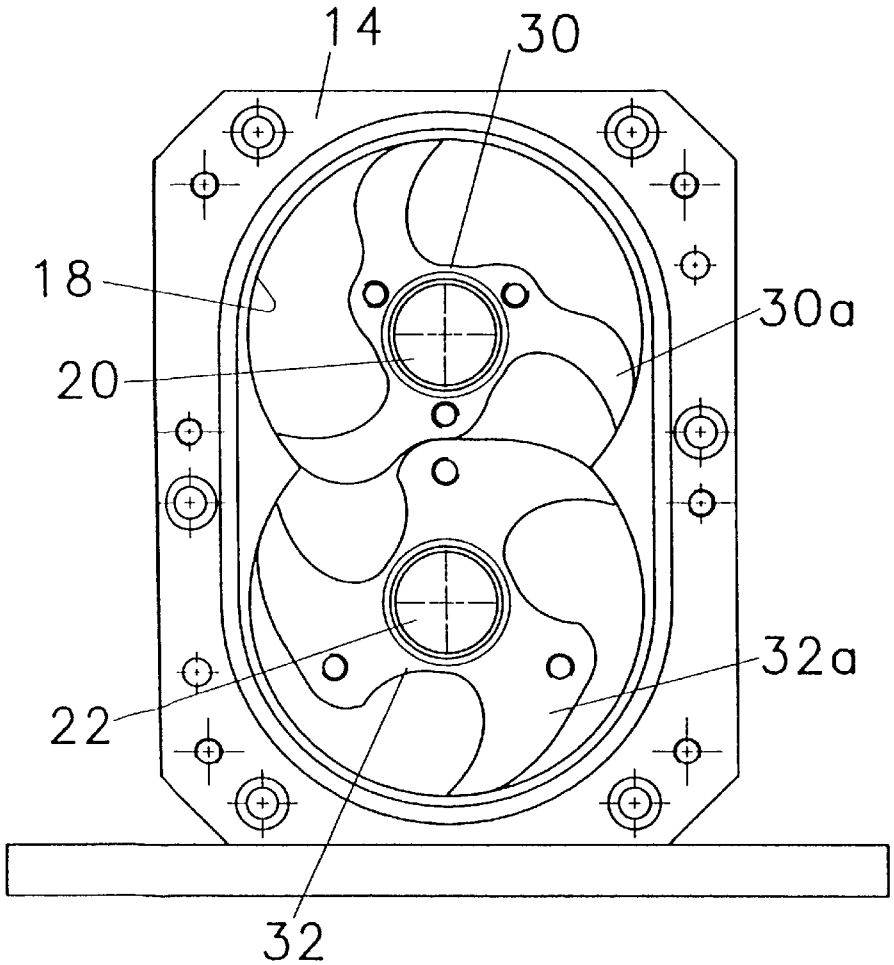

Other advantages and features of the invention ensue from the description below of a preferred embodiment and from the drawing to which reference is made. The following is shown in the drawing:

FIG. 1 a longitudinal section of the rotary piston machine according to the invention;

FIG. 2 a view along line II—II in FIG. 1;

FIG. 3 a view along line III—III in FIG. 1; and

FIGS. 4*a* to 4*h* schematic views of various rotor positions to explain the mode of operation.

The rotary piston machine is described below with reference to the example of a pump for simultaneously generating compressed air and vacuum. However, the invention is not restricted to such a use.

The single-stage pump for simultaneously generating compressed air and negative pressure has a housing that consists of a load-bearing middle part 10, a housing cover 12 mounted on one side of the middle part 10, a housing ring 14 affixed to the other side of the middle part 10 and a cover plate 16 adjacent to the housing ring 14. A pump chamber 18 is formed between the middle part 10, the housing ring 14 and the cover plate 16. Two shafts 20, 22 are cantilevered parallel to each other in ball bearings and staggered with respect to each other in the wall parts of the housing cover 12 and of the middle part 10 facing each other. A pinion 24, 26 is mounted on each shaft 20, 22. The pinions 24, 26 intermesh with each other so that the shafts 20, 22 rotate with each other synchronously in opposite directions. For the rotational drive unit, the lower shaft 22 projects out of the housing cover 12.

Two rotors 30, 32 are arranged on the free ends of the shafts 20, 22 that extend into the pump chamber 14. Since the load application formed by the rotors 30, 32 is not located between but rather outside of the bearings, the result is a cantilevered shaft bearing. Each of the rotors 30, 32 is adjustably attached to the associated shaft 20 or 22. As can be seen in FIG. 2, each rotor 30, 32 has three blades 30*a* and 32*a* respectively. Seen from the side, the pump chamber 18 has the shape of two intersecting circles that are joined together in a figure-eight pattern. The blades 30*a* of the rotor 32 have a shape that differs from the shape of the blade 32*a* of the rotor 32. The geometry of the blades 30*a*, 32*a* and of the pump chamber 18 is configured in such a way that, when the rotors 30, 32 rotate, several separate cells are defined —as is explained in greater detail below with reference to FIGS. 4*a* through 4*h*—in that the blades 30*a*,32*a* slide so as to be free of contact above each other and along the outer perimeter of the pump chamber 18 with a sealing gap of a fraction of 1 mm.

The cover plate 16 is provided with a number of recesses that are closed off towards the outside by a mounted closure plate 36. Two flanged sockets 42, 44 are screwed into the closure plate 36. The upper flanged socket 42 forms the suction port and is connected to a recess 50 of the cover plate 16. The lower flanged socket 44 forms the pressure port and is connected to a recess 52 of the cover plate 16. Two additional recesses 54*a*,54*b* in the cover plate 16 are open towards the outside to the atmosphere and form charging connections.

Figures 4A, 4B, 4C:
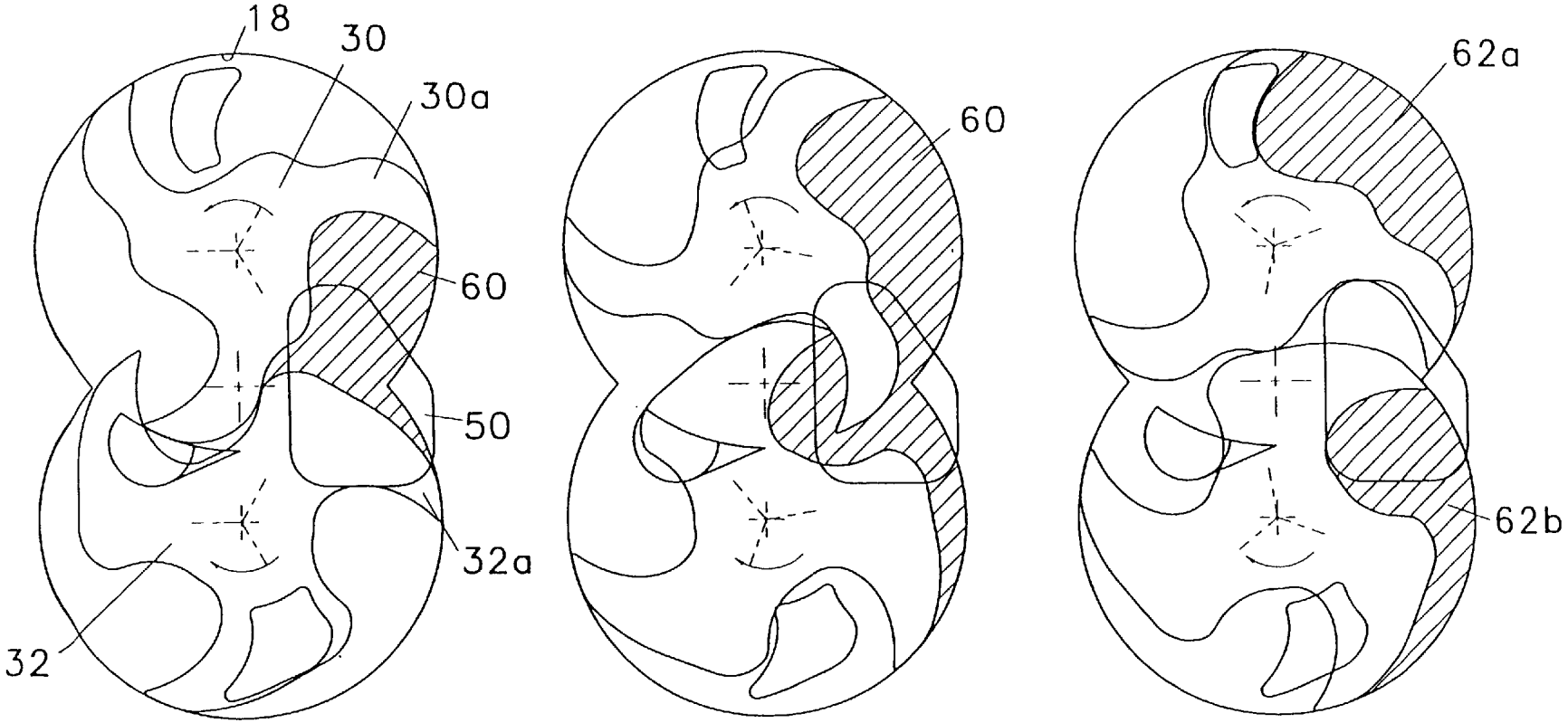

FIG. 4*a* shows the rotors 30, 32 in a rotating position in which their blades 30*a*,32*a*,together with the wall of the pump chamber 18, define a closed joint cell 60 that is only connected to the recess 50. The volume of this cell 60 increases during the further rotation of the rotors 30, 32 as can be seen in FIG. 4*b*, Thus, this cell 60 is a suction cell.

Figure 4E:
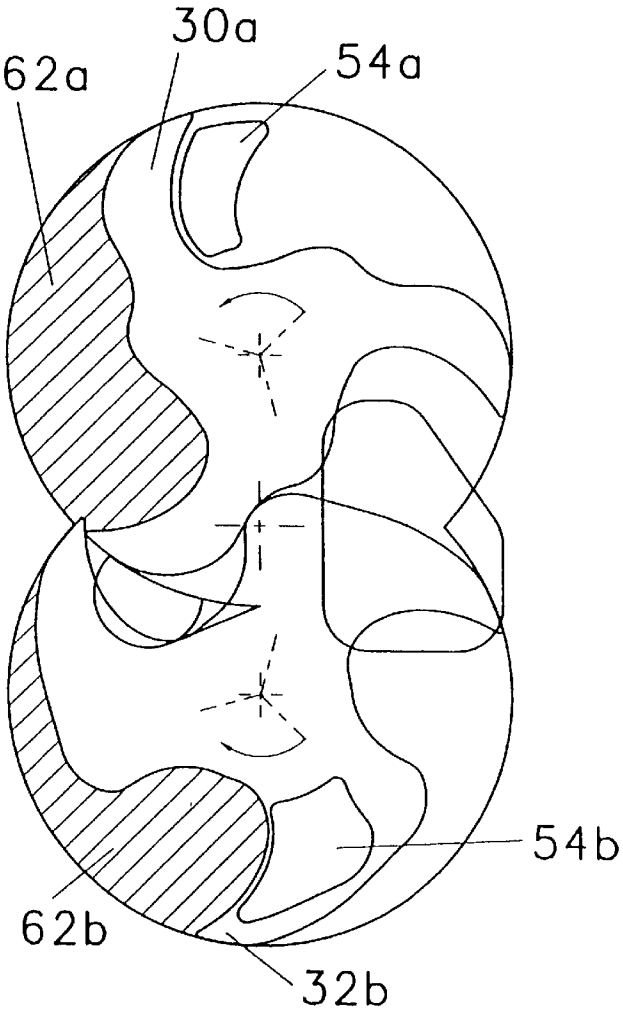
Figure 4D:
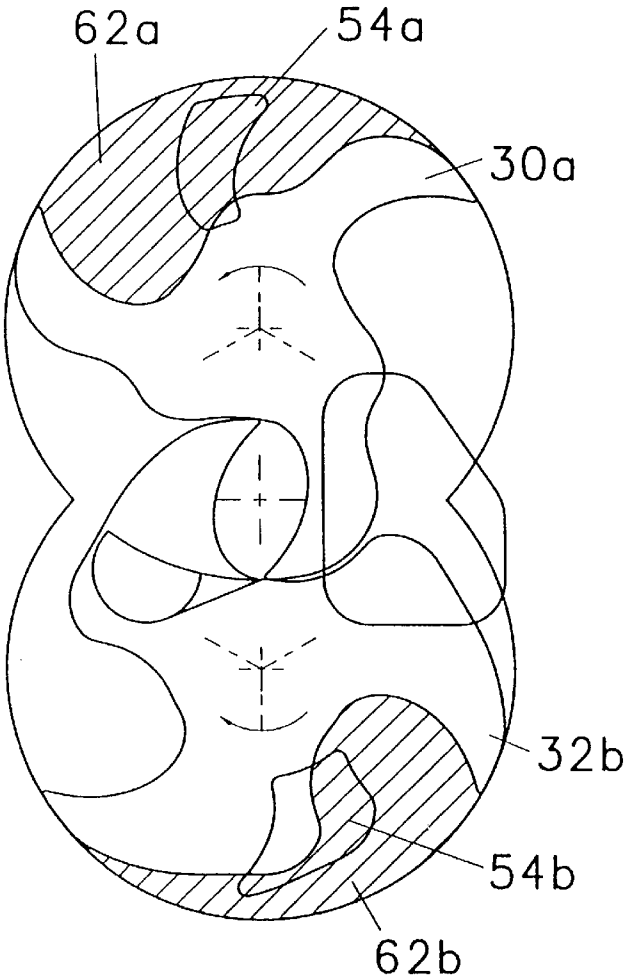
Figure 4H:
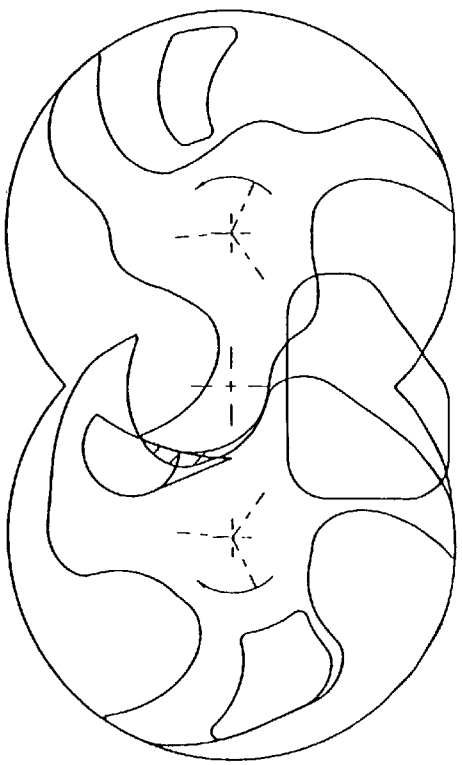
Figure 4G:
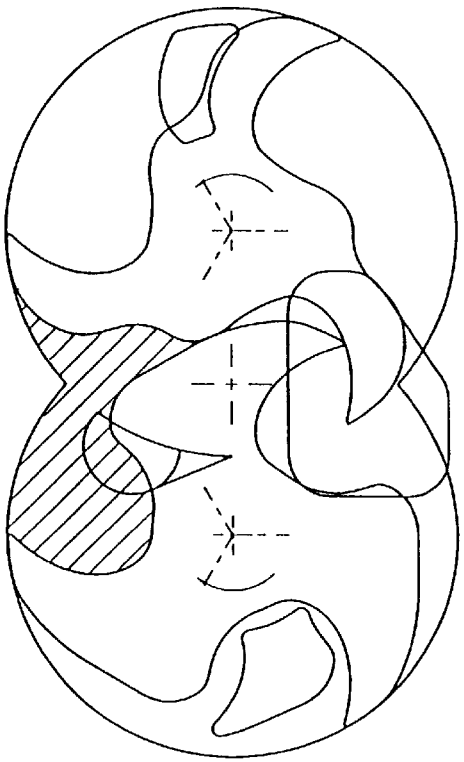
Figure 4F:
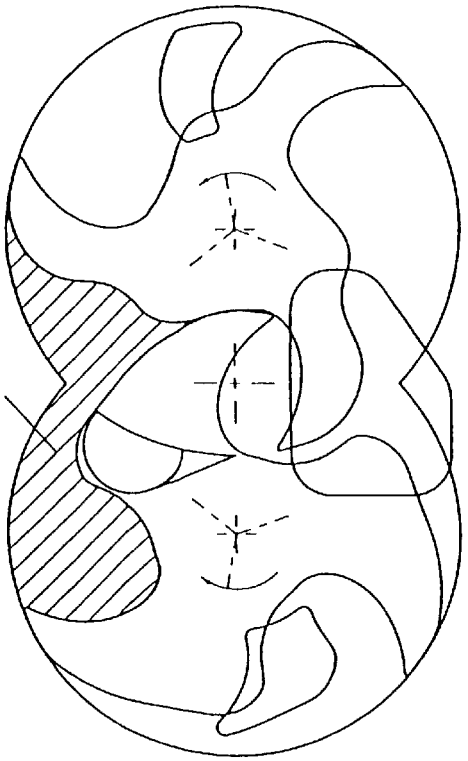

FIG. 4*c* shows two cells 62*a,* 62*b* separate from each other, which are formed immediately after the state shown in FIG. 4*b* when the cell 60 was separated into two partial cells. The cell 62*a* associated with the rotor 30 is already adjacent to the recess 54*a,*and the cell 62*b* associated with the rotor 32 is approaching the recess 54*b*. In FIG. 4*d,* the cells 62*a,* 62*b* are connected to the recesses 54*a* and 54*b* respectively that lead to the atmosphere and they are filled up with air and charged at ambient pressure, so that the air mass flow is increased. Therefore, these cells 62*a,* 62*b* are charging cells. After these charging cells 62*a,* 62*b* are separated from the associated recess 54*a* and 54*b* by the lagging blades 30*a* and 32*b,* as shown in FIG. 4*e,* the cells 62*a,* 62*b* are isobarically and isochorically shifted until, as shown in FIG. 4*f,* they unite with each other to define a pressure cell 64. With the further rotation of the rotors 30, 32, the volume of the pressure cell 64 decreases. The air compressed in the pressure cell 64 is pushed out via the recess 52 to the flanged socket 44, as is illustrated in FIGS. 4*g* and 4*h*.

The pump chamber 18 is free of any lubricant since the rotors 30, 32 operate so as to be free of contact. Towards the drive side, the pump chamber 18 is sealed off by gaskets positioned on the shafts 20, 22.

Due to the cantilevered arrangement of the rotors 30, 32 on the shafts 20, 22, which gives rise to a cantilevered bearing, access to the pump chamber is facilitated, since only the cover plate 16 needs to be removed in order to provide access. The cooling is also facilitated by this arrangement. For cooling purposes, the housing can be provided with cooling ribs and, by means of a cooling fan situated on one side of the housing cover 12, cooling air blows from the cover plate 16 over the housing ring 14, the middle part 10 and the housing cover 12.

A resonance damper that is tuned to the operating frequency of the pump serves to muffle the operating noises. Due to the three-blade configuration of the rotors, this frequency amounts to three times the rotational speed of the shafts 20, 22. The elevated operating frequency simplifies the installation of the resonance damper since its length is correspondingly reduced.

The described cantilevered bearing of the rotors is advantageous up to a volume flow of about 300 $m^3$/h. Pumps with a larger volume flow are preferably configured with rotors supported on both sides. In this case, recesses for the connections are left open in both side plates.

We claim:

1. A rotary piston machine comprising a chamber within a housing in which a pair of three-blade rotors rotate in opposite directions around parallel spaced axes and intermesh so as to be free of contact, forming separate cells with a peripheral wall of the chamber and with each other, wherein (a) said blades of the rotors are claw-like shaped and, together with the chamber, simultaneously define a suction cell whose volume increases during rotation of the rotors as well as a pressure cell whose volume decreases when the rotors rotate;

(b) said rotors, together with said chamber, define a pair of charging cells that are initially separated from each other during rotation of the rotors and that, during further rotation of the rotors, are merged with each other to define said pressure cell;

(c) a suction port passes through a side plate of the housing and opens up into the chamber opposite the suction cell;

(d) a pressure port passes through a side plate of the housing and opens up into the chamber opposite the pressure cell;

(e) at least one charging cell has an associated charging port.

2. The rotary piston machine according to claim 1, wherein before being merged, the charging cells are moved essentially isobarically and isochorically within the pump chamber.

3. The rotary piston machine according to claim 1, wherein said chamber is free of lubricant.

4. The rotary piston machine according to claim 1, wherein said chamber is delimited between two parallel side plates, said ports being recessed in at least one of the side plates.

5. The rotary piston machine according to claim 1, and forming a pump for simultaneously generating pressure and negative pressure.

6. The rotary piston machine according to claim 1, wherein each rotor is cantilevered on an associated shaft.

7. The rotary piston machine according to claim 6, wherein said shafts are synchronized by two pinions that intermesh with each other.

* * * * *